US005550339A

United States Patent [19]

Haugh

[11] Patent Number: 5,550,339

[45] Date of Patent: Aug. 27, 1996

[54] VARIABLE SPEED TACTILE SWITCH

[75] Inventor: James E. Haugh, Granger, Ind.

[73] Assignee: CTS Corporation, Elkhart, Ind.

[21] Appl. No.: 331,422

[22] Filed: Oct. 31, 1994

[51] Int. Cl.[6] ..... H01H 13/70; H01C 10/10

[52] U.S. Cl. ..... 200/5 A; 338/99

[58] Field of Search ..... 200/85 R, 86 R, 200/512–517, 5 A, 6 A; 178/18, 19; 338/99, 114

[56] References Cited

U.S. PATENT DOCUMENTS

| | | | |
|---|---|---|---|
| 3,392,247 | 7/1968 | Check | 200/86 R |
| 3,440,522 | 4/1969 | Kruse | 338/119 X |
| 3,895,288 | 4/1975 | Lampen et al. | 338/119 X |
| 3,911,215 | 10/1975 | Hurst et al. | 178/18 |
| 4,220,815 | 9/1980 | Gibson et al. | 178/18 |
| 4,235,141 | 11/1980 | Eventoff | 84/672 |
| 4,360,716 | 11/1982 | Fiorella | 200/5 A |
| 4,444,998 | 4/1984 | House | 178/19 |
| 4,494,105 | 1/1985 | House | 178/19 |
| 4,651,123 | 3/1987 | Zepp | 338/176 |
| 4,687,885 | 8/1987 | Talmage, Jr. et al. | 178/18 |
| 4,694,126 | 9/1987 | Aiken, Jr. et al. | 200/5 A |
| 4,707,570 | 11/1987 | Ide et al. | 178/18 |
| 4,746,894 | 5/1988 | Zeldman | 338/99 |
| 4,810,992 | 3/1989 | Eventoff | 339/99 |
| 4,975,676 | 12/1990 | Greehalgh | 338/114 |

*Primary Examiner*—J. R. Scott
*Attorney, Agent, or Firm*—Albert W. Watkins

[57] ABSTRACT

A low cost, highly sensitive tactile pointing device includes a planar substrate, an insulating spacer about a periphery of the substrate, and a planar cover. The cover in an active area carries an electrically conductive film designed to contact a conductive film carried upon an active area of the substrate. An insulating spacer and conductive dot are also located at some point within the active area to form a non-contacting rest area. Appropriate forces applied in a direction normal to the plane of the substrate or cover cause deflection, leading to contact between the cover and the substrate. The point of contact identifies intent, direction and magnitude.

11 Claims, 3 Drawing Sheets

VARIABLE SPEED TACTILE SWITCH

BACKGROUND OF THE INVENTION

1. FIELD OF THE INVENTION

This invention pertains generally to interfaces between humans and tools, and more specifically to tactile input devices which signal both an intention and a direction of control from the human to the tool. The tool may include a large motorized vehicle or a tiny micromanipulator, and will include many other devices, both large and small.

2. DESCRIPTION OF THE RELATED ART

The ways in which humans interact with the tools of mankind has been studied and improved upon since the beginnings of man. With each improvement, in either the tool or the method of interaction, some benefit comes. The benefit may be in greater output per unit of time or in greater power or influence. In either case, the motivation has been sufficiently great to cause a continued evaluation of both the tool and the interface between humans and the tool.

With the great progress made recently in the field of electronics, electrical and electronic controls are a part of most modern tools. These tools may take the form of automobiles, computers, appliances, toys, laboratory equipment, and other diverse machines and devices. Some of these controls may have some intelligence in the form of a computer microchip and a computer program. Other controls require direct input from an operator and respond only thereto, such as large servo systems. The electrical or electronic controls will typically monitor some type of actuator for a signal or specific input from the human operator, and the control system will generate an electrical output which will in some way control another device. Often times there is a need for determining one or several factors which include an intention on the part of the operator to provide input, an indication of the magnitude of the input, and also an indication of a direction of intent.

The devices used to provide input from the human are as varied as the equipment which is controlled. Any parameter which is generally known to be measurable electrically has been used as the basis for an input device. Resistive, capacitive, inductive, magnetic, and piezoelectric devices have all been devised to monitor for input from a human to the device, and to convert the input to an electrical signal which may then be relayed on to other electrical devices.

Among the relatively recent innovations are computer mice, trackballs, force sensitive resistors, strain gauges, and digitizing tablets. Each of these devices convert one form of input or another from a human to an electrical signal which may be monitored by associated electronics. However, these devices are restricted in a number of undesirable ways. For example, the computer mouse requires significant free surface area for manipulating the rolling ball. Additionally, mice are prone to making poor contact either between the typical ball and rollers or between the ball and surface, leading to poor control. Trackballs require rapid hand motions together with great dexterity. Precision is usually sacrificed, though trackballs offer the advantage of being self-contained, thereby resolving some of the disadvantages of computer mice. Digitizing tablets are typically quite large to gain any resolution, and in addition are typically quite complex and expensive. Capacitive, inductive and other tactile sensors, voice actuators and other various input devices tend to be more complicated electronically, and are often more susceptible to damage, environment and external electromagnetic interference.

Force sensitive resistors in one form or another have recently offered much promise through a combination of smaller sizes, lower costs and enhanced reliability and performance. This is all achieved through a variety of designs incorporating a variety of resistor materials from strain gauge resistors whose resistance changes in accord with a gauge factor to compressible resistor materials whose resistance is dependent upon the degree of compression, to contactor type variable resistors where either a sliding contactor or a flexible film may be brought into contact with a resistor material to induce a voltage output.

The present invention is of this last category, utilizing a flexible film as a contact material. U.S. Pat. No. 4,444,998, incorporated herein by reference in entirety, is most exemplary of this technology. Therein, one or more flexible resistive films are arranged in planes parallel to a conductive planar member. Pressure applied to the flexible films causes electrical contact to occur with the conductive planar member. Intent to control the device is thereby established, and, based upon the position of the contact, which in the disclosed embodiment may be anywhere within the two axes of the plane, a direction and magnitude may be determined by the electronics. This prior art interface device offers simplicity in manufacture and significant resistance to environment and external electromagnetic interference. However, the device does not offer small size and precision together in one device. The size of the human operator's finger relative to the pad must be small for any sensitivity and precision. If the finger is large relative to the device, just deflection of the finger as force is applied leads to a change in output. A light touch will read differently than a hard touch. Further, the zero or center point is difficult to control, and will be affected by the geometry of the finger and the consistency of the resistor film.

There is a need in the industry for a very small and relatively low cost device which will provide a reliable indication of intent, direction and magnitude. Such a device will have wide and diverse industrial applicability, as outlined above.

SUMMARY OF THE INVENTION

Two relatively planar members are arranged to be parallel and closely spaced. One or both of the two members is flexible, allowing tactile forces normal to the planar members and within an active area to deflect the planar members into mutual contact at the point of the normal force. Separating the two members are a first electrically non-conductive spacer positioned at the extremes of the active areas of the planar members and a second electrically non-conductive spacer positioned at a predetermined position of non-intent within the active areas. At least one of the two relatively planar members contains a relatively more conductive region adjacent to the second electrically non-conductive spacer, in the non-intent position.

Tactile forces applied at the region of non-intent are prevented from inducing electrical connection between the two planar members by the second electrically non-conductive spacer, while tactile forces just offset from the region of non-intent will cause electrical connection. The result is a finger resting position where no intention will be signalled. Contact between surfaces signals intention, and, depending upon placement of the tactile force, direction and magnitude. The inclusion of the second electrically non-conductive spacer and the relatively more conductive region ensure consistent response throughout the planar region and greater sensitivity to small magnitudes, thereby enabling a smaller planar area than found in similar prior art devices.

A further feature of the present invention resides in the ability to transilluminate the tactile switch by placement of an optic source at the center of the more conductive region adjacent the second electrically non-conductive spacer. Performance is not altered by this illumination.

DESCRIPTION OF THE PREFERRED EMBODIMENT

Figure 1:
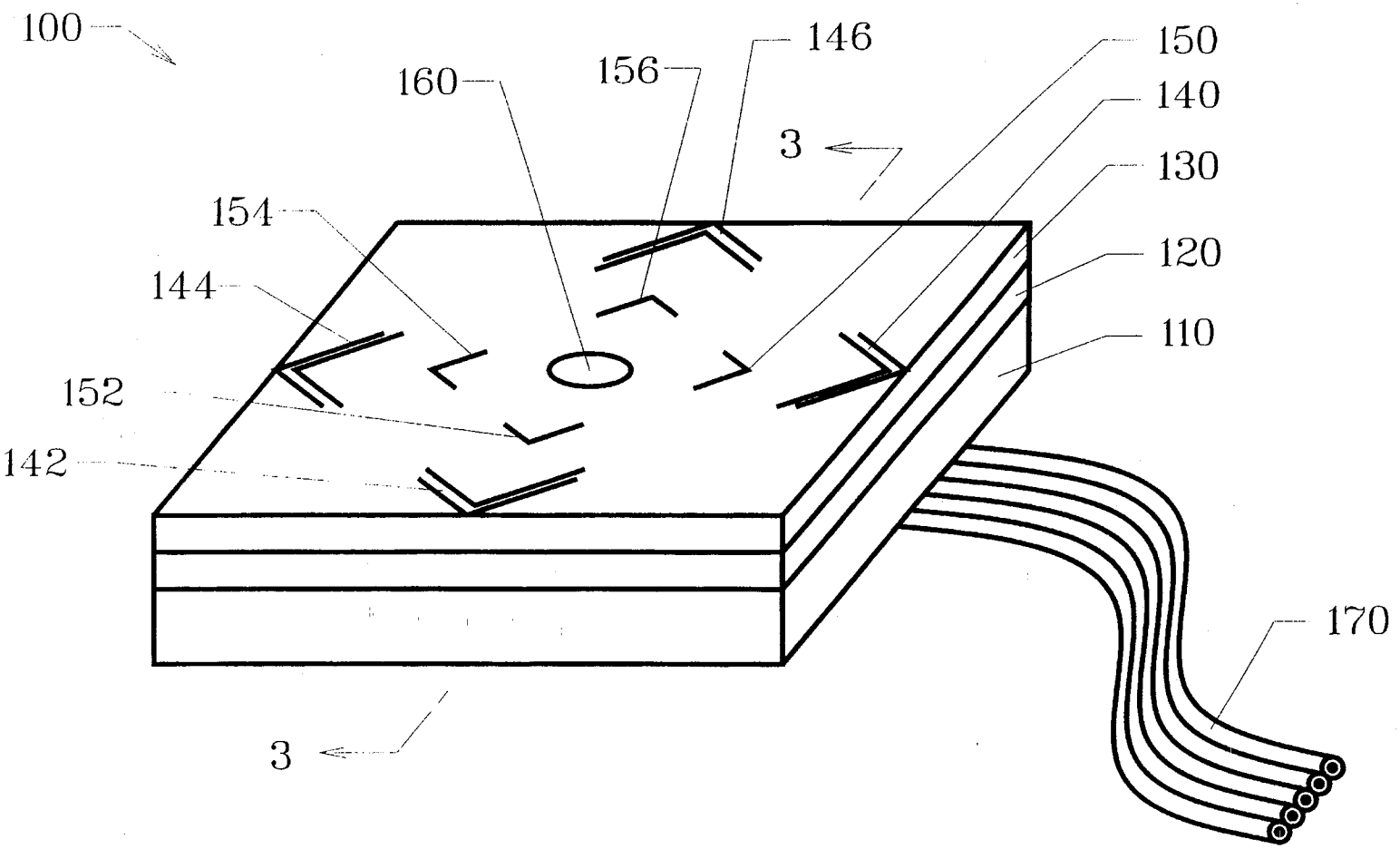
FIG. 1 illustrates a preferred embodiment of the invention from a projected view.

A variable speed tactile switch 100 designed in accord with the present invention is illustrated by projected view in FIG. 1. Switch 100 has a relatively rigid substrate 110, such as FR4, a common glass-filled epoxy circuit board material. As will be understood, a wide variety of materials will be suitable for substrate 110 and the other components described hereinbelow. The choice of materials, except where noted otherwise, is provided merely to enable one of ordinary skill in the art to design and construct a working prototype with a minimum of effort in accord with all enablement and best mode requirements. Electrical connection to tactile switch 100 is achieved through wiring cable 170, which terminates at various conductive locations upon the bottom side of substrate 110.

On top of substrate 110 is a spacer ring of electrically insulating material 120, preferably a polymer material coated on both sides with adhesive. Non-porous double sided tape materials might be used for spacer 120, or, alternatively, adhesive coated Kapton. Spacer 120 serves to bind together in a spaced manner substrate 110 and cover film 130. Cover film 130 is a Mylar film sufficiently thin as to be flexible. This film is used commonly in the field of touch panel controls to form flexible membrane switches.

Cover film 130 is patterned on an exterior surface thereof with a variety of indicia, including: large magnitude indicia 140, 142, 144 and 146; small magnitude indicia 150, 152, 154 and 156; and rest position 160. These indicia provide a reference to the human of relative axes of motion and relative magnitudes. In addition, rest position 160 provides a point where intent, magnitude and direction are all non-existent. While four directions are illustrated in the preferred embodiment, those of ordinary skill will recognize that the invention is not so limited and may include from two directions to as many directions as may be required for the application. The indicia may be stencilled upon the surface, or may be formed by any of a number of well known processes.

Cover film 130 is coated on an inner surface thereof (visible in FIG. 3) with a conductive layer 330. Layer 330 may be formed by stencil or screening with a conductive polymer material such as silver filled epoxy, or may be formed in a variety of other known techniques including vapor deposition. A noble or precious metal is preferred where this layer is selected to be a conductive material, to prevent the adverse affects environment has on more base metals. In this regard, silver is a suitable material.

Figure 2:
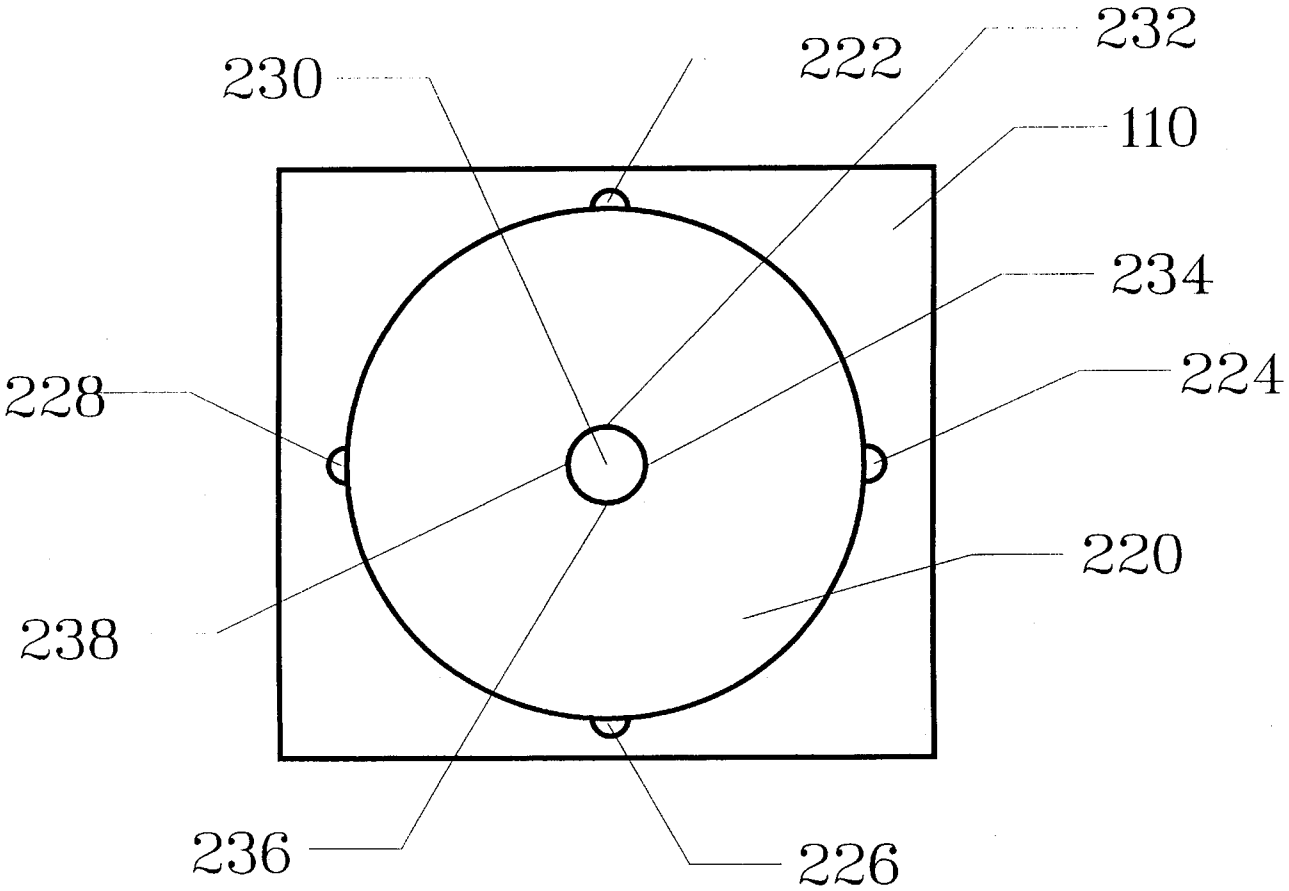
FIG. 2 illustrates the preferred embodiment of FIG. 1 from a top view with cover film 130 removed.

Substrate 110 is shown in FIG. 2, with cover film 130 and spacer 120 removed. Substrate 110 has patterned thereon a resistive film 220. Resistive film 220 is terminated electrically at four points 222, 224, 226 and 228 that roughly correspond to the four directions of the indicia 140–156 on top of cover film 130. In the preferred embodiment these conductive termination points 222–228 form two axes along which an electrical potential may be developed. A location of contact between resistive film 220 and conductive film 330 (best seen in FIG. 3) may then be monitored by the voltages independently developed along the two axes. House describes suitable associated electrical circuitry required to accomplish this task in U.S. Pat. No. 4,444,998 previously incorporated herein. One of skill in the art will also recognize that the number of axes is not limited by the invention and may include one to a virtually unlimited number of axes.

In the center of resistor film 220 is a dot or circle of conductive material 230. Conductive material 230 serves to even the electrical potential in the position corresponding to rest position 160. FIG. 2 illustrates this by the fact that the electrical potential at points 232, 234, 236 and 236 will be equal. The use of this conductive dot increases the voltage gradient found for example between point 232 and point 222, while also providing limited compensation for variances in resistivity across film 220 to ensure a more nearly even voltage drop from any of points 222–228 and dot 230.

Returning now to FIG. 3, the arrangement of the internal components may be more clearly seen. Substrate 110 has a number of conductive vias formed therein, including vias 344 and 348 which serve to provide electrical access to points 224 and 228. In the final assembly of FIG. 1 though not visible, wiring 170 is attached to each of these vias. There are two vias for each desired electrical axis. While not all electrical axes must be so terminated, failure to do so will only reduce the number of axes available. In no other way will the features of the invention be harmed. A single via 310 is provided which extends through substrate 110 and spacer 120 to a conductive tab 320 extending from conductive film 330. In this way, electrical connection between conductive film 330 and wiring 170 is achieved.

Figure 3:
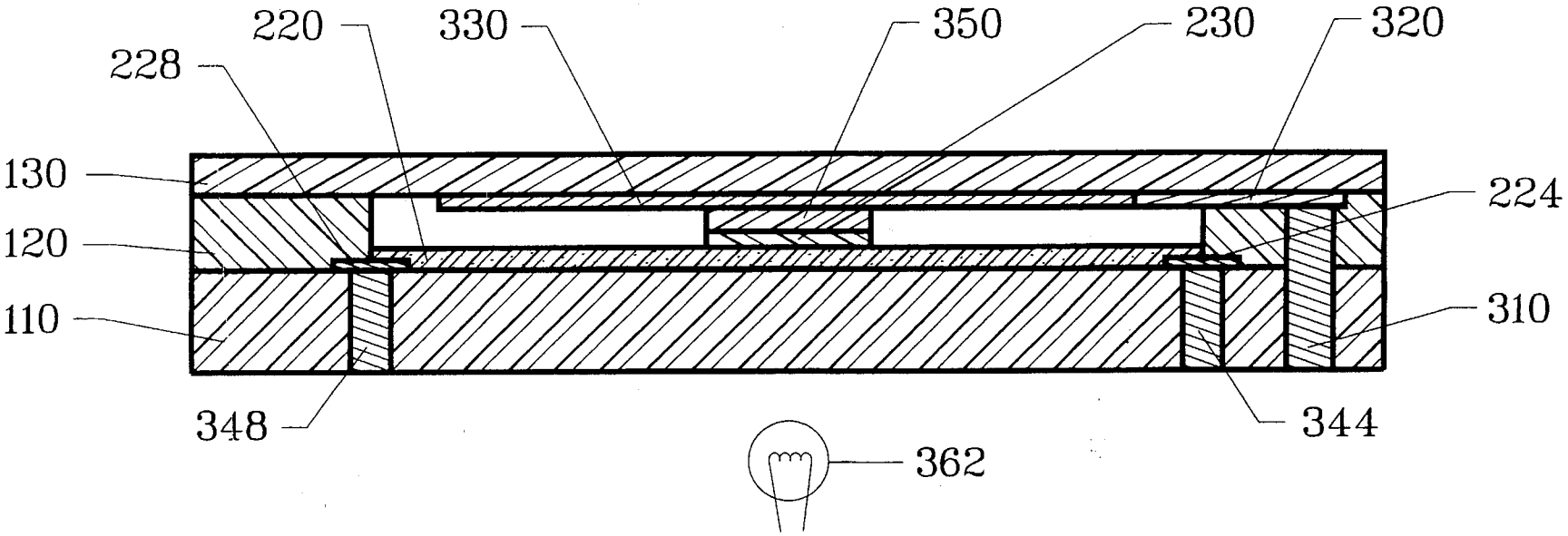
FIG. 3 illustrates the preferred embodiment of FIG. 1 in sectional view taken along section line 3 shown in FIG. 1, but with wiring 170 removed for simplicity and clarity.

Conductive material 230 is visible also in FIG. 3, and is in vertical and horizontal alignment with second insulating spacer 350. A finger pressing at rest position 160 will only press against substrate 110 and resistor film 220 through second insulating spacer 350. No electrical connection between films 220 and 330 will occur. This lack of electrical connection is a signal of non-intent to control. However, as the operator moves off of rest position 160 towards (by way of example) indicia 150, a deflection of Mylar cover film 130 will occur, and, if sufficient pressure is applied, conductive layer 330 will contact resistive film 220 near point 234. This will signal the direction (towards 150) and a minimum magnitude. Sliding the finger further towards indicia 140 will increase the magnitude until 140 is reached, where a maximum magnitude is achieved. Both the direction and magnitude signalled by the invention are continuously variable, and sensitivity is at a maximum. The width and shape of the person's finger do not control the low magnitude indication. Only that portion of the person's finger which presses down outside of rest position 160 will affect direction and magnitude.

While not specifically illustrated, a light or other optic source 362 may also be provided. The source may be positioned behind or in substrate 110, centered within conductive material 230. In this instance, conductive material 230 will take a ring or donut shape, leaving a small opening in the center thereof for the optic source. When a clear or translucent material such as Kapton is used for insulating spacer 350 and a clear or translucent film is used for cover film 130, the tactile switch of the present invention may then be transilluminated. Openings in conductive layer 330 may be required also, depending upon layer 330 transparency.

While the foregoing details what is felt to be the preferred embodiment of the invention, no material limitations to the scope of the claimed invention is intended. Further, features and design alternatives that would be obvious to one of ordinary skill in the art are considered to be incorporated herein. By way of example, the invention may be implemented in the form of a single axis device similar to those illustrated in U.S. Pat. No. 3,895,288 also incorporated herein. While substrate 110 is described in the preferred embodiment as a rigid material for exemplary purposes, substrate 110 may be flexible. At least one of the cover and the substrate must be capable of deforming, and, optionally, both may flex. Similarly, the materials for layer 330 as described are conductive and for layer 220 as resistive. These materials may be reversed, or may both be resistive. Additionally, the indication of a human finger is also exemplary. Any object capable of applying deflection forces is certainly contemplated. Fingers, pencils, pointers, and even machines may all be sensed by this invention. Those of ordinary skill in the variable resistor industry are well versed in all of the possible variants. The scope of the invention is set forth and particularly described in the claims hereinbelow.

I claim:

1. A sensor for sensing intent, direction and magnitude comprising:

first and second contact members extending in planes parallel to but spaced from each other, said first contact member being flexible and resilient so as to deform upon the application of a force normal to said first contact member;

first and second means for conducting electricity, said first conducting means deforming with said first contact member upon said application of said normal force, said first conducting means and said first contact member further being sufficiently flexible as to permit said first conducting means to make electrical contact with said second conducting means when said normal force reaches a sufficient magnitude, said first conducting means and said first contact member further being sufficiently resilient as to substantially return to an initial shape prior to an application of said normal force of said sufficient magnitude;

a first electrically insulating means for spacing said first and second contact members a predetermined distance apart, said first electrically insulating means positioned apart from an active area formed by areas of possible contact between said first and second conducting means;

a second electrically insulating means for spacing said first and second contact members a predetermined distance apart, said second electrically insulating means positioned within an active area formed by areas of possible contact between said first and second conducting means to thereby define a region of non-contact within said active area;

an electrical circuit formed by said first conducting means and said second conducting means and further including a first termination and a second termination, said electrical circuit having a nearly infinite resistance between said first and said second termination indicative of an open circuit when no normal force is applied to said first contact member, said nearly infinite resistance to thereby signal a lack of intent, said electrical circuit having a finite and determinable resistance during said application of said normal force at a first location within said active area and outside of said region of non-contact within said active area, said finite and determinable resistance varying as a function of a distance between said region of non-contact and said first location, wherein said finite and determinable resistance thereby signals an intent and a magnitude and direction of said intent.

2. The sensor of claim 1 wherein said first means for conducting electricity is integral to said first contact member.

3. The sensor of claim 1 wherein said first means for conducting electricity is a film formed upon said first contact member.

4. The sensor of claim 1 wherein said first electrically insulating spacing means defines a periphery of said active area, and said second electrically insulating spacing means is located within said periphery of said active area and is physically separate from said first electrically insulating spacing means.

5. The sensor of claim 1 further comprising a third termination means, said first termination means directly connected to said first conducting means, said second conducting means electrically connected to said second and said third termination means, said second and said third termination means defining a sense axis along said second conducting means.

6. The sensor of claim 5 further comprising a region of relatively greater electrical conductivity than the balance of said second conducting means, said region of greater conductivity located between said second and said third terminations.

7. The sensor of claim 5 wherein said region of greater conductivity is located within said region of non-contact within said active area.

8. The sensor of claim 1 wherein said region of greater conductivity and said region of non-contact within said active area are centered between said second and said third terminations.

9. A variable speed tactile switch comprising:

an electrically non-conductive substrate;

a first electrically conductive film patterned upon said substrate and having a second relatively more electrically conductive film patterned at a localized region upon said first electrically conductive film, said first electrically conductive film electrically terminated at a first termination and a second termination;

a first electrically non-conductive spacer outlining an active region within said first electrically conductive film;

a second electrically non-conductive spacer outlining a tactile region of non-contact within said active region which includes a majority of said relatively more conductive localized region upon said first electrically conductive film;

an electrically non-conductive flexible and resilient cover;

a third electrically conductive film patterned upon said cover, said third conductive film adjacent to said second electrically non-conductive spacer and an air space between said third conductive film and said first conductive film, said third conductive film electrically terminated at a third termination, said first, second and third electrically conductive films forming a variable resistance switch, said switch actuatable by a cover deforming force which electrically connects said first and said third conductive films, a location of said force which determines an amount of resistance of said variable resistance switch.

10. The variable speed tactile sensor of claim 9 further comprising an optic source transilluminating said variable speed tactile sensor so as to be visibly illuminated through said cover, said optic source emitting visible radiation from a point within or adjacent said relatively more conductive localized region.

11. The sensor of claim 1 wherein said region of non-contact maintains non-contact independent of a human finger applying a normal force thereto.

* * * * *